US011090222B2

(12) United States Patent
Zhou

(10) Patent No.: US 11,090,222 B2
(45) Date of Patent: Aug. 17, 2021

(54) FASCIA GUN

(71) Applicant: Xiamen Emoka Health Science & Technology Co., Ltd., Fujian (CN)

(72) Inventor: Guanghua Zhou, Fujian (CN)

(73) Assignee: Xiamen Emoka Health Science & Technology Co., Ltd., Fujian (CN)

( * ) Notice: Subject to any disclaimer, the term of this patent is extended or adjusted under 35 U.S.C. 154(b) by 224 days.

(21) Appl. No.: 16/446,627

(22) Filed: Jun. 20, 2019

(65) Prior Publication Data

US 2020/0289364 A1 Sep. 17, 2020

(30) Foreign Application Priority Data

Mar. 15, 2019 (CN) ..... 201920334848.6

(51) Int. Cl.
*A61H 23/00* (2006.01)
*A61H 23/02* (2006.01)

(52) U.S. Cl.
CPC ..... *A61H 23/006* (2013.01); *A61H 23/0263* (2013.01); *A61H 2023/002* (2013.01); *A61H 2201/0153* (2013.01); *A61H 2201/149* (2013.01); *A61H 2201/1685* (2013.01)

(58) Field of Classification Search
CPC ..... A61H 23/006; A61H 23/0263; A61H 2023/002; A61H 2201/0153; A61H 2201/149; A61H 2201/1685
See application file for complete search history.

(56) References Cited

U.S. PATENT DOCUMENTS 3,837,335 A * 9/1974 Teranishi ..... A61H 23/0254 601/103
2002/0107459 A1* 8/2002 Chang ..... A61H 7/005 601/97
2013/0138023 A1* 5/2013 Lerro ..... A61H 1/005 601/46
2020/0393026 A1* 12/2020 Chang ..... A61H 23/006

* cited by examiner

*Primary Examiner* — Timothy A Stanis
(74) *Attorney, Agent, or Firm* — JCIPRNET

(57) ABSTRACT

The invention discloses a fascia gun, which comprises a case, a motor, an eccentric gear, a guide rail, a percussion stick, a massage head group and a circuit board. A rotating shaft of the motor is connected with the eccentric gear. The percussion stick comprises a connector, a guide seat and a connecting rod. An eccentric shaft of the eccentric gear is fitted in an oblong hole of the connector. The guide rail is fitted in an axle hole of the guide seat. One end of the connecting rod is connected with the guide seat, and the other end of the connecting rod is connected with the massage head group. The fascia gun disclosed by the invention has the advantages of simple structure, beautiful appearance, small size and low cost.

12 Claims, 4 Drawing Sheets

FASCIA GUN

CROSS-REFERENCE TO RELATED APPLICATION

This application claims the priority benefit of Chinese application serial no. 201920334848.6, filed on Mar. 15, 2019. The entirety of the above-mentioned patent application is hereby incorporated by reference herein and made a part of this specification.

BACKGROUND

Technical Field

The invention relates to the technical field of massage tools, particularly to a fascia gun.

Description of Related Art

Due to increasingly rapid pace of modern urban life, most urban populations suffer from various pressure in the stressful life. After long time of work, muscles and nerves of the body are prone to fatigue and need a good rest to recover, but the body recovery will take a long time. By means of external massage tools, the recovery time will be shortened, so a lot of massage tools has appeared in the market. However, most massage devices existing in the market are large-size or medium-size devices, such as massage chairs, massage machines and others. The place and the time for users to use these devices are restricted, so it is quite inconvenient for ordinary workers to use the massage devices. Therefore, people gradually concern small massage sticks.

At present, the structure principle of handheld massagers in the market is basically to use a miniature motor to drive an eccentric hammer to rotate to generate an inertial force to make an oscillating body oscillate periodically, so as to achieve the purpose of massaging the human body. However, handheld massage sticks in the market have a complex internal structure and high production cost, and common small-size massage hammers have defects such as fixed shape of the massage head, irreplaceability of the massage head and big vibration and noise.

SUMMARY

The purpose of the invention is to provide a fascia gun having advantages of simple structure, low cost, portable convenience and easy storage.

To achieve said purpose, the invention provides as follows.

A fascia gun comprising a case, a motor, an eccentric gear, a guide rail, a percussion stick, a massage head group and a circuit board. The case is provided with a massage part on a top. A bottom of the massage part is connected with a gripping part. An accommodating space is formed in the case, in which the motor, the circuit board and the percussion stick are arranged. A rotating shaft of the motor is connected with the eccentric gear. The percussion stick comprises a connector, a guide seat and a connecting rod connected in sequence. The connector is connected with the eccentric gear and provided with an oblong hole in which an eccentric shaft of the eccentric gear is fitted. The guide seat is provided with a through axle hole. One end of the guide rail is fixed in the case, and the other end of the guide rail passes through the axle hole. One end of the connecting rod is connected with the guide seat, and the other end of the connecting rod is connected with the massage head group.

The fascia gun also comprises a permanent seat fixed in the accommodating space of the case and located in the massage part. The permanent seat is arranged between the motor and the massage head group. An accommodating groove for arranging the percussion stick is arranged at one end of the permanent seat toward the massage head group. A bottom of the accommodating groove is provided with a through hole corresponding to the oblong hole of the percussion stick. The connector and the guide seat of the percussion stick are arranged in the accommodating groove which is also provided with a guide hole penetrating through the permanent seat. One end of the guide rail is arranged in the guide hole of the permanent seat, and the other end of the guide rail penetrates through the axle hole of the percussion stick to enable the percussion stick to slide back and forth along a length direction of the guide rail.

Preferably, the case is a T-shaped or an inverted L-shaped structure. The massage part is arranged on the top of the case. The bottom of the massage part is connected with the gripping part. The massage part is connected with the gripping part by arc transition. A gripping hole is formed in a lower middle portion of the gripping part. The massage part and the gripping part of the case are internally interconnected to form the accommodating space.

Preferably, the case comprises a left case and a right case which are buckled with each other; the left case is connected with the right case by a fixing plate. Two sides of the massage part of the left case are respectively fixed with one fixing plate. One end of the fixing plate is fastened with the left case, and the other end of the fixing plate is fastened with the right case.

Preferably, the eccentric shaft is also provided with at least one shock absorber on a periphery of a portion in the oblong hole.

Preferably, the fascia gun also comprises a charging base which is arranged on a bottom of the case. The bottom of the case is provided with an adapter plate connected with the circuit board, and the charging base is internally provided with a charging panel matched with the adapter plate.

Preferably, the charging base comprises a trim cover, a middle cover, a lower cover and the charging panel arranged between the middle cover and the lower cover. One end of the middler cover is provided with a battery holder connected to the charging panel; and a center of the trim cover and that of the middle cover are respectively provided with an opening for insertion of the bottom of the case.

Preferably, the motor is fixed in the accommodating space of the case and located on an upper part of the gripping part. The rotating shaft of the motor protrudes into the massage part of the case.

Preferably, at least one of the left case and the right case is provided with a ventilation hole in a portion corresponding to the motor.

Preferably, the massage head group comprises a massage head fixing seat and a massage head detachably fitted on the massage head fixing seat which is fitted with the connecting rod of the percussion stick.

After adopting said structure, the fascia gun provided by the invention utilizes the motor to drive the eccentric gear to rotate, and utilizes the eccentric shaft to drive the percussion stick to perform percussion actions back and forth with the rotation of the eccentric gear to further drive the massage head to realize percussion massage. The fascia gun provided by the invention has a simple and beautiful appearance and is easy to hold. When massaging, a user can hold the gripping hole of the gripping part or directly hold the joint between the massage part and the gripping part like holding a gun according to the demand. The holding manner satisfies the demand of different individuals. Besides, the fascia gun is compact in structure, small in size and easy to carry and store. Moreover, the fascia gun has the advantages of simple structure and low cost, capable of improving the market competitiveness. The fascia gun is also provided with a charging base matched with a bottom of the fascia gun. When charging is required, the bottom of the case is directly inserted into the charging base to realize charging and enable the overall shape of the charging base and the case to be more beautiful and unique.

In addition, the fascia gun is also provided with a shock absorber which can play the role of shock absorption and sound elimination when used, prolong the service life of the fascia gun and improve the user experience.

DESCRIPTION OF THE EMBODIMENTS

Figure 1:
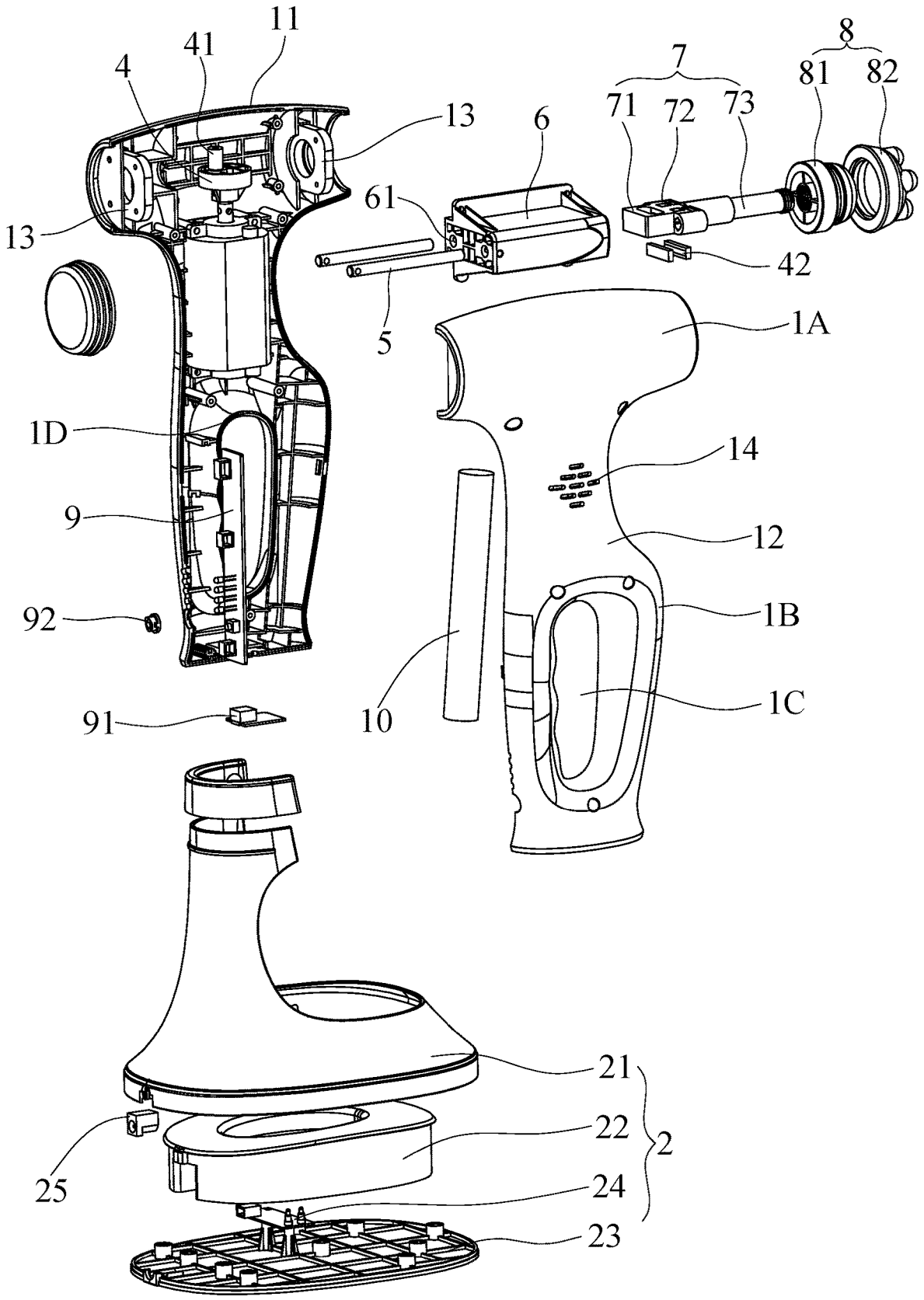
FIG. 1 is an exploded view of a fascia gun provided by the invention.

To further explain the technical scheme of the invention, the invention will be described in detail via the following specific embodiments.

In the description of the invention, the terms such as "center", "longitudinal", "transverse", "upper", "lower", "front", "back", "left", "right", "vertical", "horizontal", "top", "bottom", "internal" and "external" indicate a location or position relationship based on the location or position shown in the drawings, only for describing the invention conveniently and simplifying the description, rather than indicating or implying that the device or component must have a specific location or must be structured and operated in a specific orientation, so the terms shall not be interpreted as a limitation to the invention. In the description of the invention, unless otherwise indicated, "multiple" means two or more.

Figure 2:
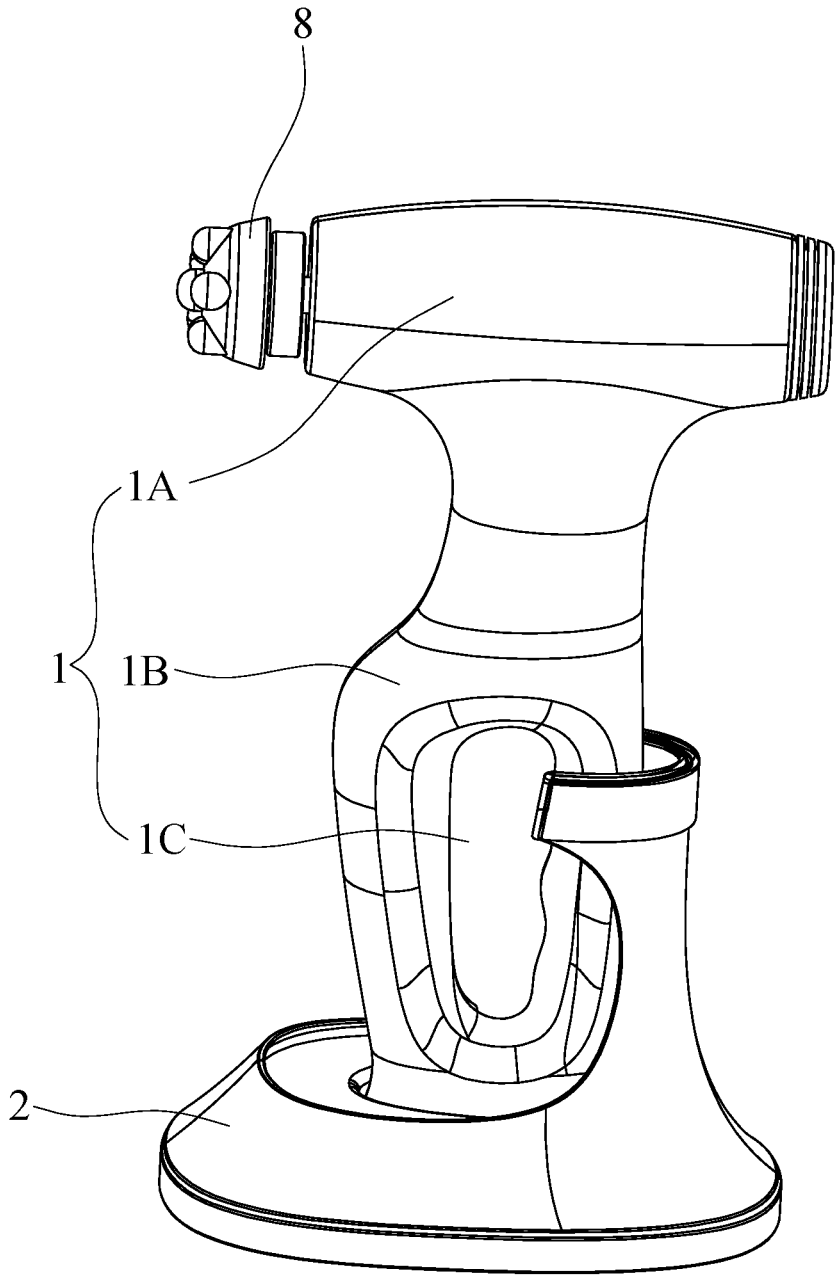
FIG. 2 is an assembly drawing of the fascia gun provided by the invention.
Figure 3:
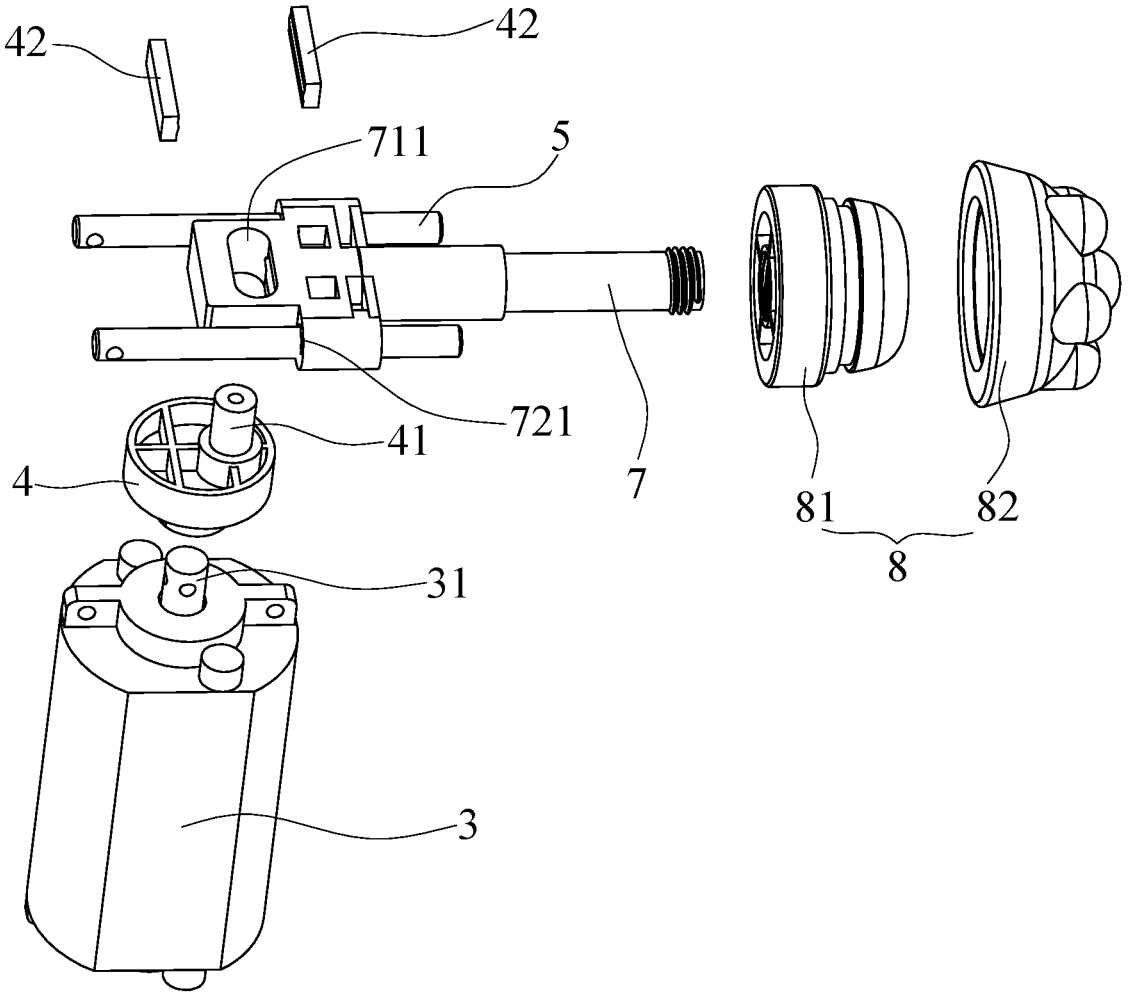
FIG. 3 is an exploded view of an internal structure of the fascia gun provided by the invention.
Figure 4:
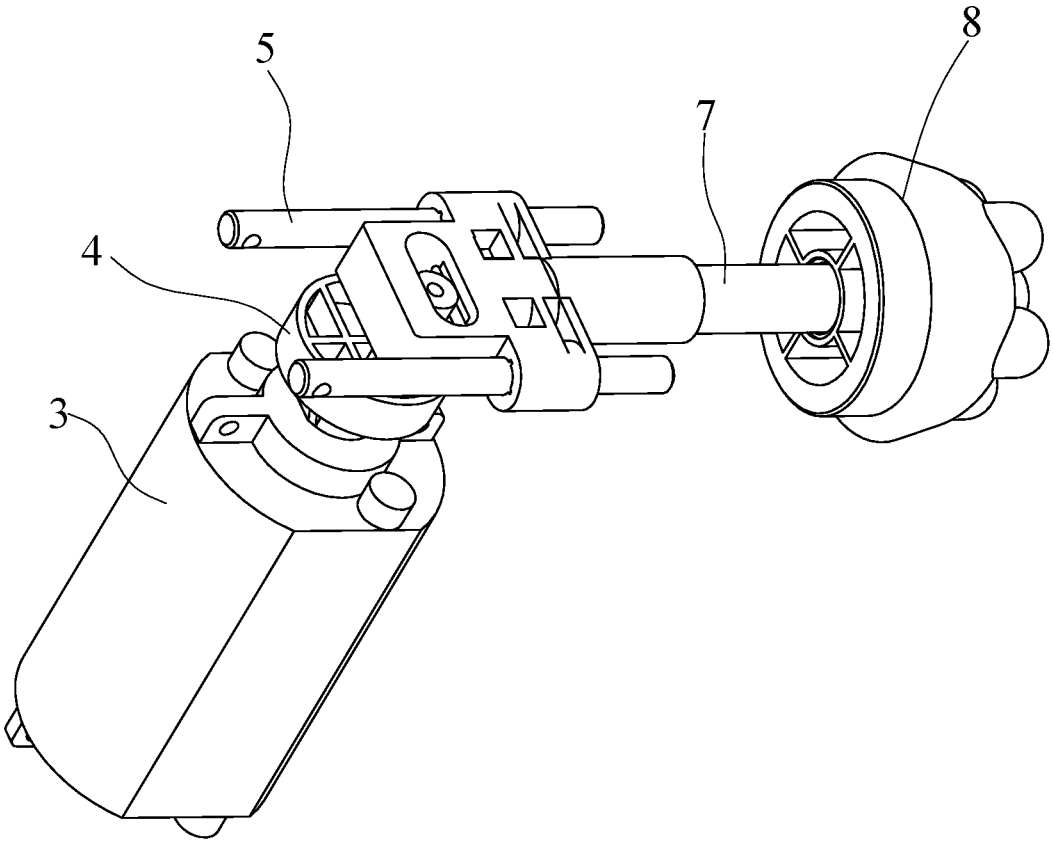
FIG. 4 is an assembly drawing of the internal structure of the fascia gun provided by the invention.

From FIG. 1 to FIG. 4, the invention discloses a fascia gun comprising a case 1, a charging base 2, a motor 3, an eccentric gear 4, a guide rail 5, a permanent seat 6, a percussion stick 7, a massage head group 8 and a circuit board 9.

The case 1 is a T-shaped or an inverted L-shaped structure. The massage part 1A is arranged on a top of the case 1. A bottom of the massage part 1A is connected with a gripping part 1B. The massage part 1A is connected with the gripping part 1B by streamlined arc transition. A gripping hole 1C is formed in a lower middle portion of the gripping part 1B of the case 1. The massage part 1A and the gripping part 1B of the case 1 are internally interconnected to form an accommodating space 1D. The case 1 comprises a left case 11 and a right case 12 which are buckled with each other. The left case 11 is connected with the right case 12 by a fixing plate 13. Two sides of the massage part 1A of the left case 11 are respectively fixed with one fixing plate 13. One end of the fixing plate 13 is fastened with the left case 11, and the other end thereof is fastened with the right case 12.

The charging base 2 comprises a trim cover 21, a middle cover 22, a lower cover 23 and the charging panel 24 arranged between the middle cover 22 and the lower cover 23. One end of the middler cover 22 is provided with a battery holder 25 connected to the charging panel 24. A center of the trim cover 21 and that of the middle cover 22 are respectively provided with an opening for insertion of a bottom of the case 1. The bottom of the case 1 is provided with an adapter plate 91 connected with the circuit board 9. The adapter plate 91 is electrically connected with the charging panel 24.

The motor 3 is fixed in the accommodating space 1D of the case 1 and located on an upper part of the gripping part 1B. A rotating shaft 31 of the motor 3 protrudes into the massage part 1A of the case 1. At least one of the left case 11 and the right case 12 is provided with a ventilation hole 14 in a portion corresponding to the motor 3. The ventilation hole 14 is used for heat dissipation of the motor 3. A top of the rotating shaft 31 of the motor is connected with the eccentric gear 4. A top of the eccentric gear 4 is provided with an eccentric shaft 41. The accommodating space 1D of the case 1 is provided with the circuit board 9 and a battery 10 below the motor 3. The circuit board 9 is provided with an on/off button 92 protruding to the outside of the case 1.

The percussion stick 7 comprises a connector 71, a guide seat 72 and a connecting rod 73. The connector 71 is connected with the eccentric gear 4. The connector 71 is provided with an oblong hole 711. The eccentric shaft 41 of the eccentric gear 4 is fitted in the oblong hole 711 of the connector 71. The eccentric shaft 41 of the eccentric gear can be driven by the motor 3 to slide back and forth in the oblong hole 711 of the connector 71 along a length direction of the hole. The eccentric shaft 41 is also provided with at least one shock absorber 42 on a periphery of a portion in the oblong hole 711. The shock absorber 42 is a soft silicone sheet or sponge, playing the role of shock absorption and sound elimination. The guide seat 72 protrudes to two sides of the connector 71, and the projections protruding from two sides of the connector 71 are respectively provided with a through axle hole 721. One end of the connecting rod 73 is connected with the guide seat 72, and the other end thereof is connected with the massage head group 8.

The permanent seat 6 is fixed in the accommodating space 1D of the case 1 and located in the massage part 1A of the case 1. The permanent seat 6 is arranged between the motor 3 and the massage head group 8. An accommodating groove for arranging the percussion stick 7 is arranged at one end of the permanent seat 6 toward the massage head group 8. A bottom of the accommodating groove is provided with a through hole corresponding to the oblong hole 711 of the percussion stick 7. The connector 71 and the guide seat 72 of the percussion stick 7 are arranged in the accommodating groove which is also provided with a guide hole 61 on two sides to penetrate through two ends of the permanent seat 6. The guide rail 5 consists of two rails correspondingly arranged in the guide holes 61 on two sides of the permanent seat 6. One end of the guide rail 5 is fixed on the permanent seat 6, and the other end thereof penetrates through the axle hole 721 of the percussion stick 7 to enable the percussion stick 7 to slide back and forth along the length direction of the guide rail 5.

The massage head group 8 comprises a massage head fixing seat 81 and a massage head 82 detachably fitted on the massage head fixing seat 81. The massage head fixing seat 81 is fitted with the connecting rod 73 of the percussion stick 7 to enable the massage head group 8 to perform percussion massage actions with the percussion stick 7. The structure of the massage head 82 can be varied. The structure shown in the drawings is one of the specific embodiments of the invention. The structure of the massage head is not limited to the shape.

The installation of the fascia gun provided by the invention comprises the steps of fixing the eccentric gear 4 on the rotating shaft 31 of the motor 3, fixing the guide rail 5 on the permanent seat 6, assembling the percussion stick 7 in the guide rail 5 and the accommodating groove of the permanent seat 6, installing the motor 3 and the permanent seat 6 in the left case 11 or the right case 12 of the case 1, fixing the massage head fixing seat 81 of the massage head group 8 on the percussion stick 7, and then fixedly assembling the left case 11 and the right case 12 and assembling the massage head 82 on the massage head fixing seat 81 to finish the installation.

Utilization of the fascia gun provided by the invention comprises the steps of initiating the on/off button 92 to drive the motor 3. The rotating shaft 31 of the motor 3 drives the eccentric gear 4 to rotate, the eccentric shaft 41 drives the percussion stick 7 to perform percussion actions back and forth with the rotation of the eccentric gear 4 to further drive the massage head 82 to realize percussion massage. The fascia gun provided by the invention has a simple and beautiful appearance and is easy to hold. When massaging, a user can hold the gripping hole 1C of the gripping part 1B or directly hold the joint between the massage part 1A and the gripping part 1B like holding a gun according to the demand. The holding manner satisfies the demand of different individuals. Besides, the fascia gun is compact in structure, small in size and easy to carry and store. Moreover, the fascia gun has the advantages of simple structure and low cost, capable of improving the market competitiveness. The fascia gun is also provided with the charging base 2 matched with a bottom of the fascia gun. When charging is required, the bottom of the case 1 is directly inserted into the charging base 2 to realize charging and enable the overall shape of the charging base and the case to be more beautiful and unique.

In addition, the fascia gun is also provided with the shock absorber which can play the role of shock absorption and sound elimination when used, prolong the service life of the fascia gun and improve the user experience.

The above embodiments and schemata do not limit the product form and style of the fascia gun provided by the invention, and any appropriate changes or modifications made by ordinary technicians in the technical field shall be deemed to be consistent with the patent scope of the invention.

What is claimed is:

1. A fascia gun, comprising a case, a motor, an eccentric gear, a guide rail, a percussion stick, a massage head group and a circuit board, wherein the case is provided with a massage part on a top; a bottom of the massage part is connected with a gripping part; an accommodating space is formed in the case, in which the motor, the circuit board and the percussion stick are arranged; a rotating shaft of the motor is connected with the eccentric gear; the percussion stick comprises a connector, a guide seat and a connecting rod connected in sequence; the connector is connected with the eccentric gear and provided with an oblong hole in which an eccentric shaft of the eccentric gear is fitted; the guide seat is provided with a through axle hole; one end of the guide rail is fixed in the case, and the other end of the guide rail passes through the axle hole; and one end of the connecting rod is connected with the guide seat, and the other end of the connecting rod is connected with the massage head group.

2. The fascia gun according to claim 1, further comprising a permanent seat fixed in the accommodating space of the case and located in the massage part, wherein the permanent seat is arranged between the motor and the massage head group; an accommodating groove for arranging the percussion stick is arranged at one end of the permanent seat toward the massage head group; a bottom of the accommodating groove is provided with a through hole corresponding to the oblong hole of the percussion stick; the connector and the guide seat of the percussion stick are arranged in the accommodating groove which is also provided with a guide hole penetrating through the permanent seat; one end of the guide rail is arranged in the guide hole of the permanent seat, and the other end of the guide rail penetrates through the axle hole of the percussion stick to enable the percussion stick to slide back and forth along a length direction of the guide rail.

3. The fascia gun according to claim 2, wherein the case is a T-shaped or an inverted L-shaped structure; the massage part is arranged on the top of the case; the bottom of the massage part is connected with the gripping part; the massage part is connected with the gripping part by arc transition; a gripping hole is formed in a lower middle portion of the gripping part; and the massage part and the gripping part of the case are internally interconnected to form the accommodating space.

4. The fascia gun according to claim 2, further comprising a charging base which is arranged on a bottom of the case, wherein the bottom of the case is provided with an adapter plate connected with the circuit board, and the charging base is internally provided with a charging panel matched with the adapter plate.

5. The fascia gun according to claim 1, wherein the case is a T-shaped or an inverted L-shaped structure; the massage part is arranged on the top of the case; the bottom of the massage part is connected with the gripping part; the massage part is connected with the gripping part by arc transition; a gripping hole is formed in a lower middle portion of the gripping part; and the massage part and the gripping part of the case are internally interconnected to form the accommodating space.

6. The fascia gun according to claim 5, wherein the case comprises a left case and a right case which are buckled with each other; the left case is connected with the right case by a fixing plate; two sides of the massage part of the left case are respectively fixed with one fixing plate; one end of the fixing plate is fastened with the left case, and the other end of the fixing plate is fastened with the right case.

7. The fascia gun according to claim 6, wherein at least one of the left case and the right case is provided with a ventilation hole in a portion corresponding to the motor.

8. The fascia gun according to claim 1, wherein the eccentric shaft is also provided with at least one shock absorber on a periphery of a portion in the oblong hole.

9. The fascia gun according to claim 1, further comprising a charging base which is arranged on a bottom of the case, wherein the bottom of the case is provided with an adapter plate connected with the circuit board, and the charging base is internally provided with a charging panel matched with the adapter plate.

10. The fascia gun according to claim 9, wherein the charging base comprises a trim cover, a middle cover, a lower cover and the charging panel arranged between the middle cover and the lower cover; one end of the middler cover is provided with a battery holder connected to the charging panel; and a center of the trim cover and that of the middle cover are respectively provided with an opening for insertion of the bottom of the case.

11. The fascia gun according to claim 1, wherein the motor is fixed in the accommodating space of the case and located on an upper part of the gripping part; and the rotating shaft of the motor protrudes into the massage part of the case.

12. The fascia gun according to claim 1, wherein the massage head group comprises a massage head fixing seat and a massage head detachably fitted on the massage head fixing seat which is fitted with the connecting rod of the percussion stick.

* * * * *